US008528892B2

(12) United States Patent
Nakamura et al.

(10) Patent No.: US 8,528,892 B2
(45) Date of Patent: Sep. 10, 2013

(54) RECORDING APPARATUS

(75) Inventors: Kazuhisa Nakamura, Nagano-ken (JP); Atsuhiko Takeuchi, Nagano-ken (JP); Kazumasa Harada, Nagano-ken (JP); Kensuke Tamai, Nagano-ken (JP); Kazutoshi Matsuzaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/343,917

(22) Filed: Jan. 5, 2012

(65) Prior Publication Data

US 2012/0175838 A1 Jul. 12, 2012

(30) Foreign Application Priority Data

Jan. 11, 2011 (JP) ..... 2011-002751

(51) Int. Cl.
*B65H 3/44* (2006.01)

(52) U.S. Cl.
USPC ..... 271/9.11; 271/171

(58) Field of Classification Search
USPC ..... 271/9.01, 9.11, 248, 270, 171
See application file for complete search history.

(56) References Cited

U.S. PATENT DOCUMENTS

| | | | | |
|---|---|---|---|---|
| 4,017,181 | A * | 4/1977 | Komaba et al. | 355/72 |
| 6,322,067 | B1 * | 11/2001 | Fujii et al. | 271/145 |
| 2006/0261535 | A1 | 11/2006 | Shiohara et al. | |
| 2007/0075477 | A1 | 4/2007 | Shiohara | |

FOREIGN PATENT DOCUMENTS

| | | |
|---|---|---|
| JP | 2006-273565 | 10/2006 |
| JP | 2007-091445 | 4/2007 |

* cited by examiner

*Primary Examiner* — Michael McCullough

(57) ABSTRACT

A recording apparatus includes a lower tray that stores recording media therein, an upper tray that stores recording media therein and capable of being mounted on the lower tray, and an edge guide which is disposed on the lower tray and has a guide surface along which the sheet edge is guided, wherein the edge guide is configured such that, when the upper tray is not mounted on the lower tray, the guide surface extends to a space for storing recording media in the upper tray.

2 Claims, 5 Drawing Sheets

RECORDING APPARATUS

BACKGROUND

1. Technical Field

The present invention relates to edge guides along which the edge of recording media is aligned. The present invention also relates to recording media cassettes having the edge guide and recording media feeding devices, and further relates to recording apparatuses having the recording media cassette and the recording media feeding device, such as printers or facsimile machines.

2. Related Art

Sheet cassettes that are detachably mounted in the main body of an apparatus are commonly used. In particular, JP-A-2006-273565 and JP-A-2007-91445 disclose a detachable sheet cassette (tray) having a dual-container configuration composed of upper and lower sheet containers. A sheet container that stores sheets therein in a recording apparatus is generally called various names, including "cassette", "tray" and so forth. In the following description, an entire unit that is detachably mounted in the main body of the apparatus is referred to as a "cassette", while each sheet container that is provided in the cassette is referred to as a "tray".

In a sheet cassette having a dual-tray configuration as mentioned above, an upper tray is slidably and rotatably movable relative to a lower tray. The sheet cassette can be switched between a state in which the sheets can be fed from the upper tray and a state in which the sheets can be fed from the lower tray by slidably moving the upper tray. Further, a space for storing sheets in the lower tray is opened by turning the upper tray.

With such a dual-tray configuration of a sheet cassette, however, it is not possible to remove the upper tray from the lower tray. Accordingly, it is not always useful for a user who does not frequently use the upper tray, since the upper tray reduces the sheet storing capacity of the lower tray. Further, an additional action to turn the upper tray is necessary when loading sheets into the lower tray.

One solution to the above technical problems is to provide an upper tray that is removable from the lower tray. That is, the sheet storing capacity of the lower tray increases when the upper tray is removed from the lower tray. However, this results in a problem in that a guiding height of the edge guide that is provided on the lower tray is not enough to guide and feed the sheets in an appropriate manner.

SUMMARY

An advantage of an aspect of the invention is that, specifically in a sheet cassette having a multiple-tray configuration composed of upper and lower trays, an edge guide that is capable of guiding the edge of sheets in an appropriate manner even when an increased number of sheets is stored (stacked) in the lower tray is provided.

According to an aspect of the invention, there is provided a recording apparatus in a first example including a lower tray that stores recording media therein, an upper tray that stores recording media therein and capable of being mounted on the lower tray, and an edge guide which is disposed on the lower tray and has a guide surface along which the sheet edge is guided, wherein the edge guide is configured such that, when the upper tray is not mounted on the lower tray, the guide surface extends to a space for storing recording media in the upper tray.

With this configuration, when the upper tray is removed from the lower tray, the recording media storing capacity of the lower tray can be increased without causing a feeding problem such as skew feeding.

In a second example, it is preferable that the guide surface is formed by a plate member that is rotatable about a rotation axis which intersects the guide surface, and the guide surface is configured to have a height that varies as the plate member rotates.

With this configuration, the guide surface is formed by the plate member that is rotatable about a rotation support, and the guiding height varies as the plate member rotates, thereby achieving a configuration in which the guiding height of the guide surface varies in a simple format low cost. In addition to that, since the plate member is rotatable about the rotation axis which intersects the guide surface, the guide surface can be formed as a single surface regardless of the guiding height, that is, the guide surface can be formed as a smooth, flat or seamless surface regardless of the guiding height, thereby preventing the recording media from getting stuck during setting.

In a third example, it is preferable that the plate member is provided with a biasing unit that biases the plate member in a rotation direction in which the height of the guide surface increases, and the edge guide is configured such that, when the upper tray is not mounted on the lower tray, the guide surface extends to a space for storing recording media in the upper tray by means of the biasing unit.

With this configuration, since the plate member is in a state of being biased in a rotation direction in which the guiding height increases, an operability to increase the guiding height is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
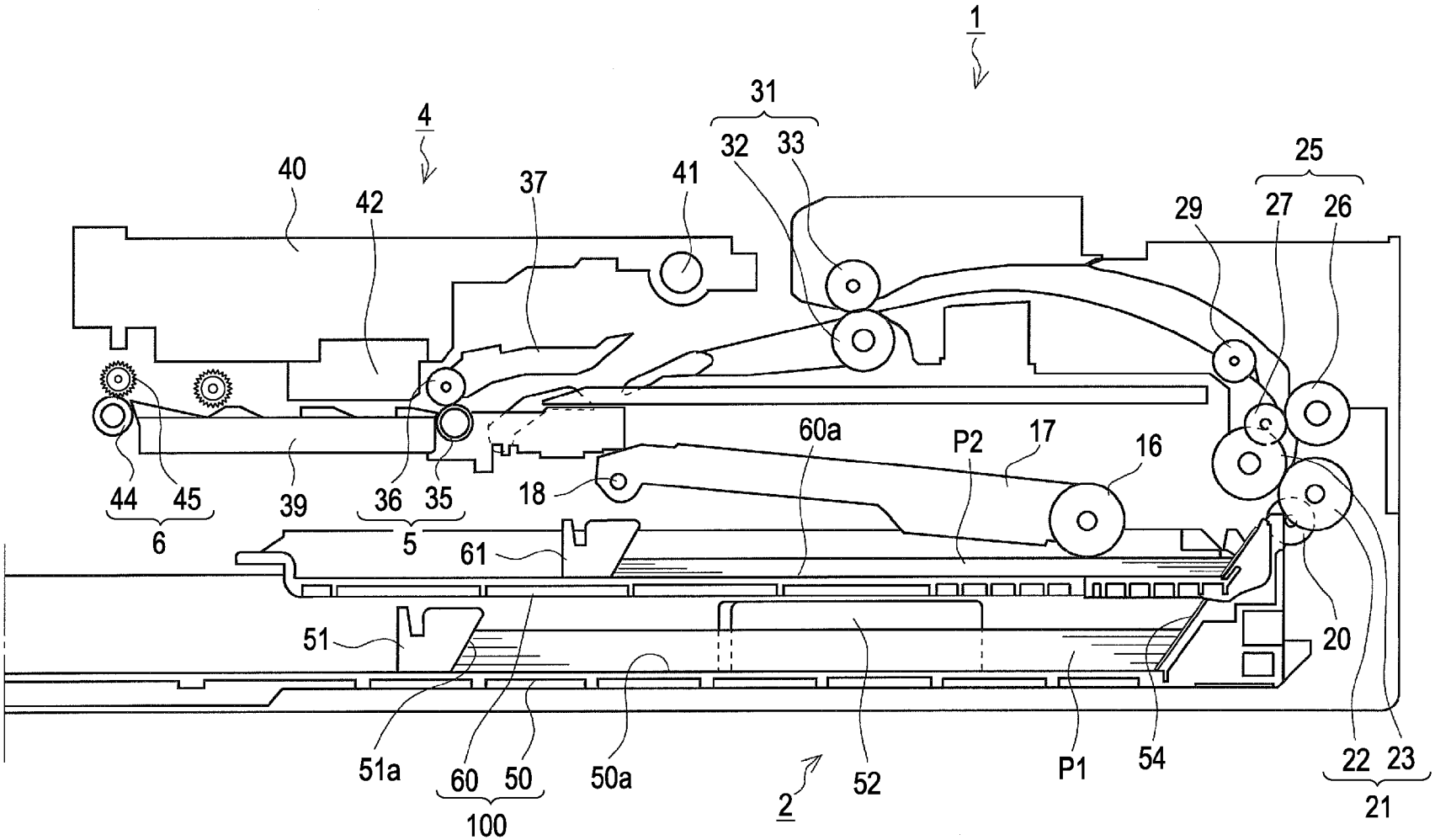
FIG. 1 is a side sectional view which shows a sheet transportation path in a printer according to one embodiment of the invention.
Figure 2:
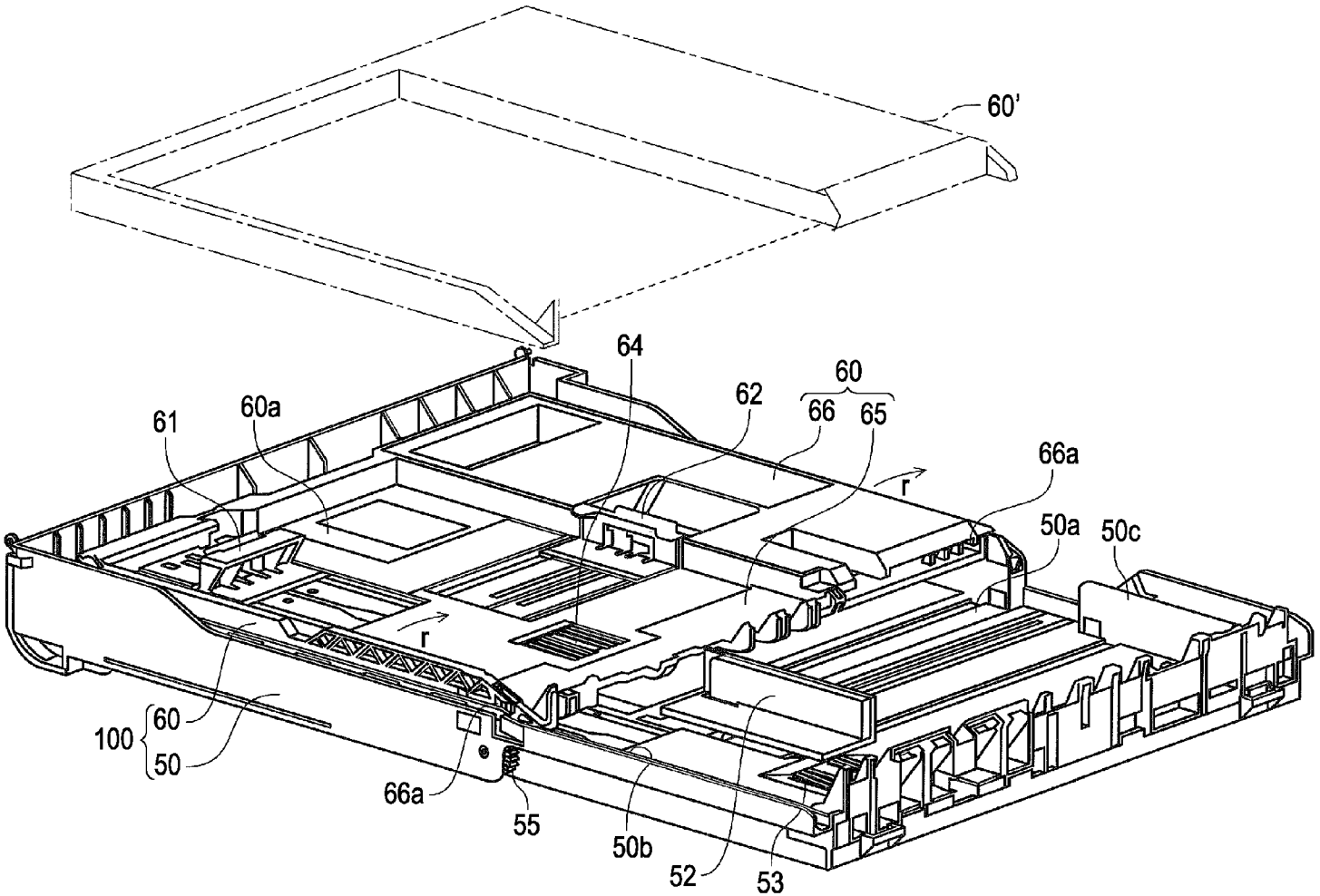
FIG. 2 is a perspective view of a sheet cassette according to one embodiment of the invention.
Figure 3:
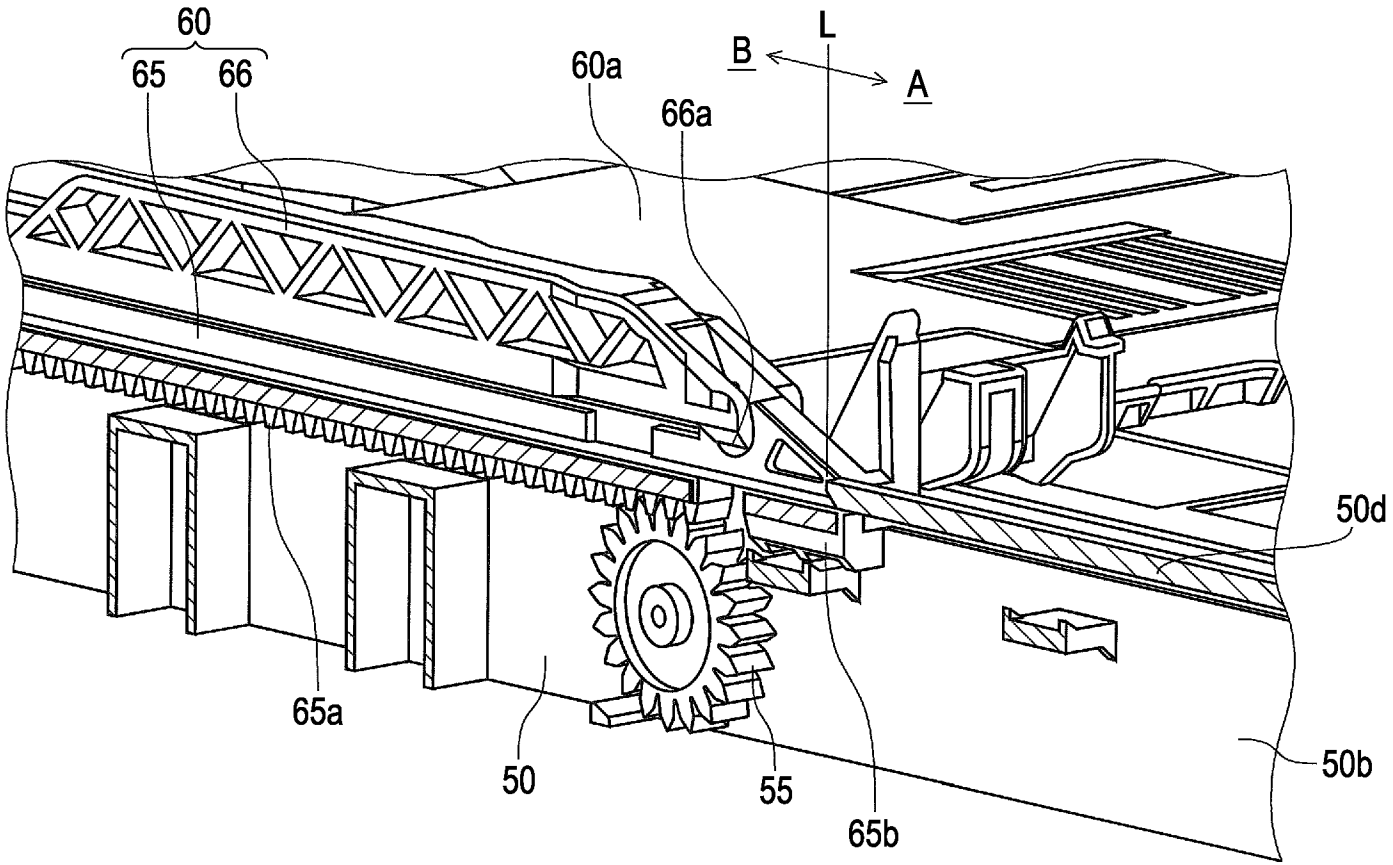
FIG. 3 is a perspective view of a section of an essential part of the sheet cassette according to one embodiment of the invention.

An embodiment of the invention will be described below with reference to FIGS. 1 to 5. FIG. 1 is a side sectional view which shows a sheet transportation path in an ink jet printer (hereinafter referred to as a "printer") 1 which is an example of a "recording apparatus" of the invention. FIG. 2 is a perspective view of a sheet cassette 100 which is an example of a "recording media cassette" of the invention. FIG. 3 is a perspective view of a section of an essential part of the sheet cassette 100. In addition, the rightward direction in FIG. 1 is a sheet feeding direction, and a direction extending through the drawing of FIG. 1 between the front side and the back side of the drawing is a sheet width direction.

Figure 4A:
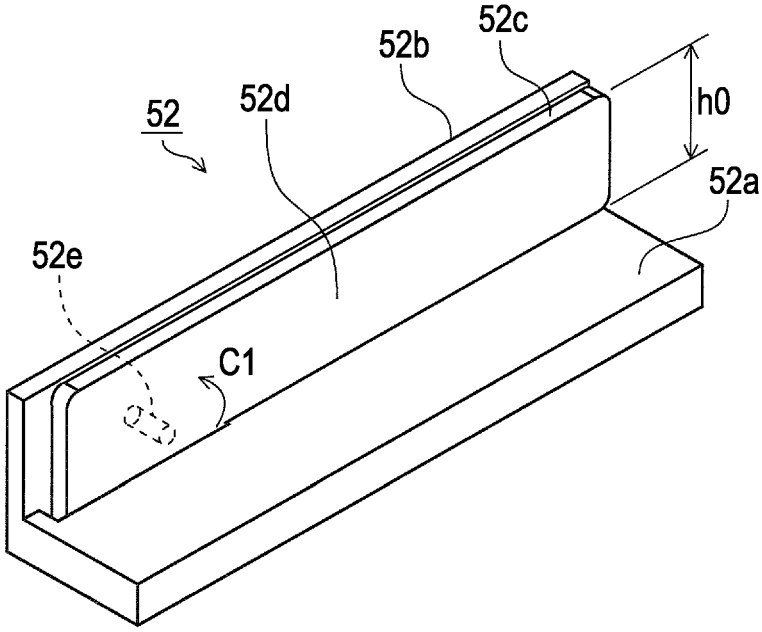
FIGS. 4A and 4B are perspective views of one embodiment of an edge guide according to the invention.
Figure 4B:
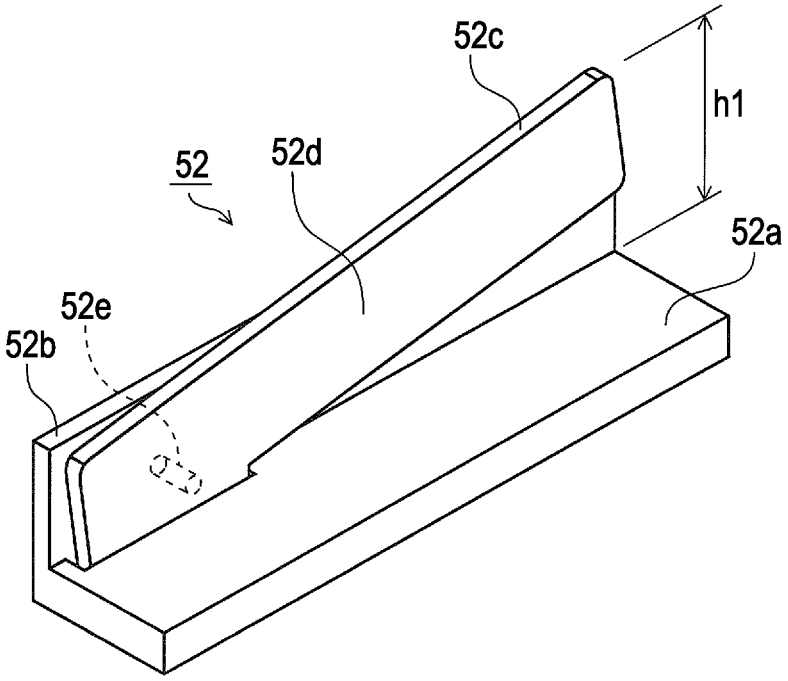
Figure 5A:
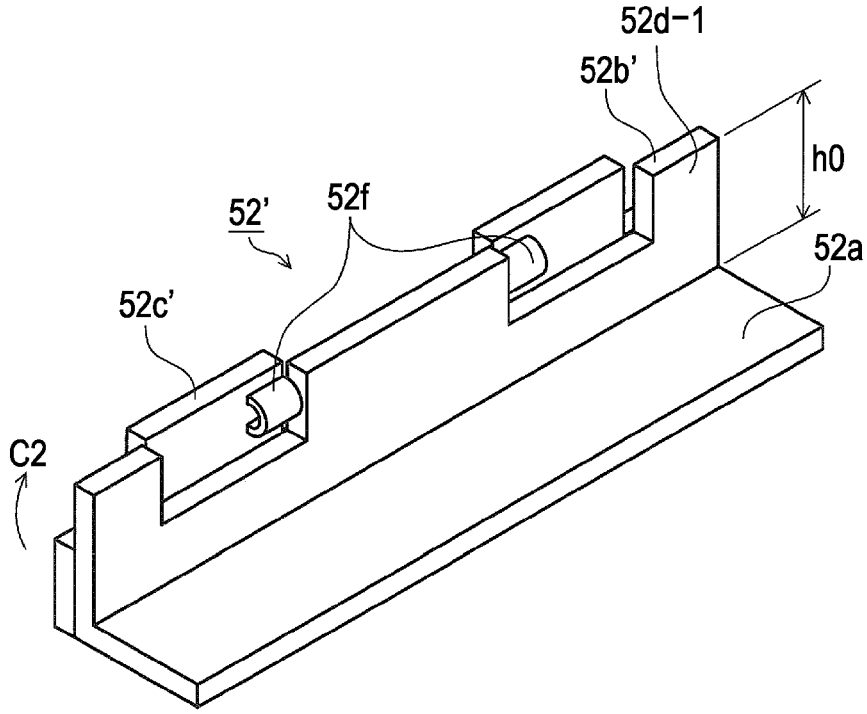
FIGS. 5A and 5B are perspective views of one embodiment of an edge guide according to the invention.
Figure 5B:
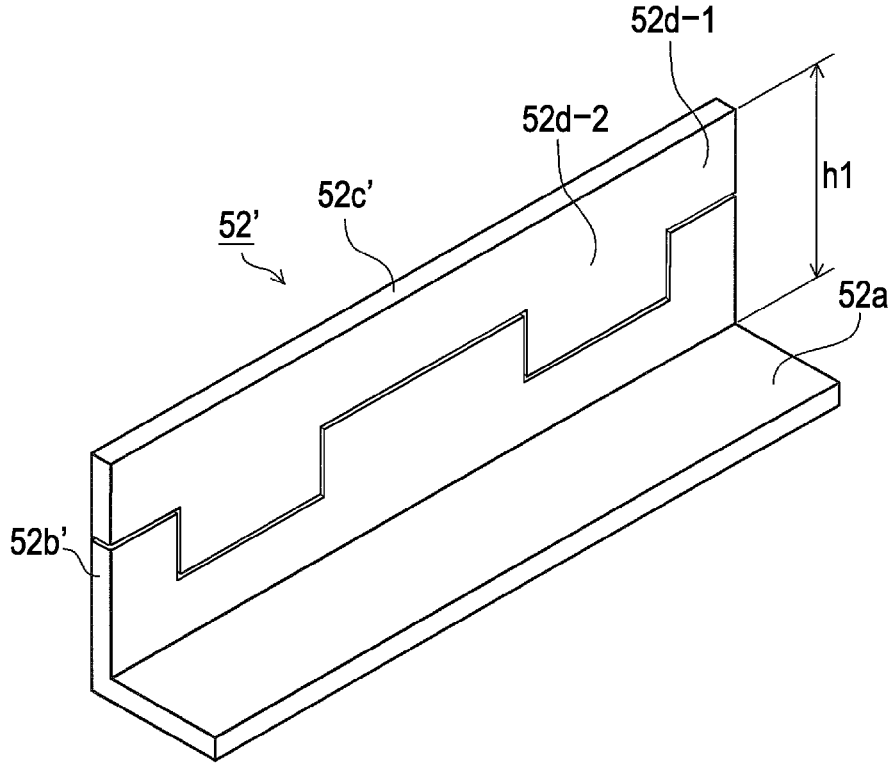

FIGS. 4A and 4B are perspective views of an edge guide 52 according to one embodiment of the invention, showing a state in which a guide surface of the guide is at a normal position (first state) and a state in which the guide surface of the guide is at an elevated position (second state), respectively. Further, FIGS. 5A and 5B are perspective views of an edge guide 52' according to another embodiment of the invention, showing a state in which a guiding height of a guide surface is at a normal position (first state) and a state in which the guiding height of the guide surface is at an elevated position (second state), respectively.

1. Overall Configuration of Printer

An overall configuration of the printer 1 will be described below with reference to FIG. 1. The printer 1 includes a feeding device 2 in the bottom portion of the apparatus. The feeding device 2 is configured to feed sheets (cut sheets in general) as an example of the "recording media" one by one toward an output stacker (not shown in the figure) disposed on the front side of the apparatus (left side in FIG. 1) after a recording unit 4 has performed recording (ink jet recording).

Components disposed on the sheet transportation path will now be described in further detail. The feeding device 2 includes a sheet cassette 100, a pick up roller 16, guide roller 20 and a separation unit 21.

The sheet cassette 100, in which a plurality of sheets P can be set in a stacked state, is removably mounted in the main body of the apparatus from the front side with respect to the feeding device 2. The sheet cassette 100 includes two sheet containers, that is, a lower tray 50 which is disposed on the lower side thereof and constitutes a base of the sheet cassette 100, and an upper tray 60 which is disposed above the lower tray 50 and is slidably movable between a feedable position and a stand-by area.

In FIG. 1, the sheets stored in the lower tray 50 and the upper tray 60 are denoted by P1 and P2, respectively (hereinafter collectively referred to as "sheet P" as long as the sheets do not have to be individually identified).

The pick-up roller 16 which is rotated by a motor (not shown in the figure) is provided on a pivot member 17 that pivotally moves about a pivot shaft 18. When the upper tray 60 has been slid to the rear-most position (in a retracting direction of the sheet cassette 100, which is the leftward direction in FIG. 1), that is, when the upper tray 60 is in a stand-by area, the pick-up roller 16 comes into contact with the uppermost sheet P1 stored in the lower tray 50 and rotates so as to feed the uppermost sheet P1 from the lower tray 50.

Moreover, when the upper tray 60 has been slid to the front-most position, which is the abutment position (in a mounting direction of the sheet cassette 100, which is the rightward direction in FIG. 1), that is, when the upper tray 60 is in a feedable position, the pick-up roller 16 comes into contact with the uppermost sheet P2 stored in the upper tray 60 and rotates so as to feed the uppermost sheet P2 from the upper tray 60.

When the upper tray 60 is positioned in the feedable position (as shown in FIG. 1), the separating slope 54 of the lower tray 50 extends toward the leading end of the sheets stored in the upper tray 60 beyond the front inner wall of the upper tray 60 such that the separating slope 54 serves as a separation unit when the sheets are fed from the upper tray 60. That is, the separating slope 54 of the lower tray 50 is used as a common separation unit for the lower tray 50 and the upper tray 60.

A freely rotatable guide roller 20 is disposed at a position downstream of the separating slope 54. Further, a separation unit 21 composed of a separation roller 22 and a driving roller 23 is disposed at a position downstream of the guide roller 20. The separation roller 22 has an outer periphery made of an elastic material and is capable of pressingly contacting the driving roller 23 while being in a state in which a predetermined rotation resistance is applied by a torque limiter mechanism. Accordingly, the subsequent sheets P are not permitted to be fed with the uppermost sheet P passing between the separation roller 22 and the driving roller 23, thereby preventing double feeding of the sheets P. The driving roller 23 is rotated by a motor, which is not shown in the figure, in the direction by which the sheets P are fed downstream.

A first intermediate feeder 25 is disposed at a position downstream of the separation unit 21. The first intermediate feeder 25 is composed of a driving roller 26 that is rotated by a motor, which is not shown in the figure, and an assisting roller 27 that is driven by the driving roller 26 so as to nip the sheet P therebetween such that the sheet P is fed further downstream. In addition, reference numeral 29 denotes a driven roller that reduces a passing load which is generated when the sheet P (particularly, the trailing edge of the sheet P) passing along a curved turn-around path.

Further, a second intermediate feeder 31 is disposed at a position downstream of the driven roller 29. The second intermediate feeder 31 is composed of a driving roller 32 that is rotated by a motor, which is not shown in the figure, and an assisting roller 33 that is driven by the driving roller 32 so as to nip the sheet P therebetween such that the sheet P is further fed downstream.

A recording unit 4 is disposed at a position downstream of the second intermediate feeder 31. The recording unit 4 includes a transportation unit 5, a recording head 42, a lower sheet guide 39 and an output unit 6. The transportation unit 5 is composed of a transportation driving roller 35 that is rotated by a motor and a transportation driven roller 36 that is supported by the upper sheet guide 37 so as to be in pressing contact with and driven by the transportation driving roller 35. When the sheet P enters the transportation unit 5, the transportation driving roller 35 rotates so that the sheet P is fed downstream in an accurate manner while being nipped between the transportation driving roller 35 and the transportation driven roller 36.

The recording head 42 is disposed at the bottom of the carriage 40. The carriage 40 is actuated by a motor, which is not shown in the figure, so as to reciprocate in a main scanning direction while being guided by a carriage guide shaft 41 that extends in the main scanning direction (the direction extending across the drawing of FIG. 1 between the front side and the back side of the drawing). In addition, the carriage 40 is of a so-called off carriage type in which ink cartridges are not loaded. The ink cartridges (not shown) are separately provided from the carriage 40, so that ink is supplied from the ink cartridges to the recording head 42 via ink supply tubes (not shown).

A lower sheet guide 39 is disposed at a position opposite the recording head 42 such that a distance between the sheet P and the recording head 42 is defined by the lower sheet guide 39. Further, an output unit 6 is provided at a position downstream of the lower sheet guide 39 so as to output the sheet P on which recording has been performed.

The output unit 6 is composed of an output driving roller 44 that is rotated by a motor, which is not shown in the figure, and an output driven roller 45 that is in contact with and driven by the output driving roller 44 and is configured to output the sheet P on which recording has been performed by the recording unit 4 toward a stacker provided on the front side of the apparatus, which is not shown in the figure.

2. Details of Sheet Cassette

While the printer 1 has been briefly described above, the sheet cassette 100 will be further described below in detail with reference to FIGS. 2 and 3. The bottom 50*a* of the lower tray 50 is provided with the edge guide 51 (FIG. 1) that is slidably movable in the sheet feeding direction (that is, sheet length direction) such that the position of the trailing edge of the sheet P1 is aligned with the edge guide 51.

Moreover, the lower tray 50 is further provided with the edge guide 52, which is slidably movable in a direction perpendicular to the sheet feeding direction (that is, sheet width direction), such that the position of one side edge of the sheet P1 is aligned with the edge guide 52. The other side edge is aligned with a side wall 50*b* (FIG. 2) of the lower tray 50. In other words, the side wall 50*b* of the lower tray 50 serves as a fixed edge guide.

A guide surface 51*a* of the edge guide 51 that defines the position of the trailing edge of the sheet P1 is formed as a slope that is substantially parallel with the separating slope 54 such that the leading end of a stack of sheets is aligned with the separating slope 54 when the edge guide 51 abuts the trailing edge of the sheet P1. The edge guide 52 that defines the position of the side edge of the sheet P1 will be described later in detail.

A high friction member 53 is placed on the bottom 50*a* of the lower tray 50 at a position corresponding to the contact point between the pick-up roller 16 and the sheet P1. The high friction member 53 holds the stack of sheet during feeding of a sheet so that the whole stack of sheets is not fed downstream by the pick-up roller 16.

Similarly to the lower tray 50, the bottom 60*a* of the upper tray 60 is provided with an edge guide 61 that is slidably movable in the sheet length direction and an edge guide 62 that is slidably movable in a sheet width direction. Further, a high friction member 64 is placed at a position corresponding to the contact point between the pick-up roller 16 and the sheet P2.

A movable mechanism of the upper tray 60 will now be described. The upper tray 60 includes a slide member 65 and a tray base 66 such that the slide member 65 is slidably movable in the sheet feeding direction and the opposite direction with respect to the side walls 50*b* and 50*c* of the lower tray 50.

A tray base 66 is provided to form a space for storing the sheets. The tray base 66 is rotatable about rotation shafts 66*a* on both sides thereof in a direction indicated by the arrow r with respect to the sliding member 65. In addition, a rotation limit of the upper tray 60 (tray base 66) according to this embodiment is greater than 90 degrees and smaller than 180 degrees. That is, when the upper tray 60 has been turned to the maximum extent, a space for storing the sheets in the lower tray 50 is opened so that the sheets can be stored in the lower tray 50.

As shown in FIG. 3, a rack 65*a* is formed on the lower side of one side face of the sliding member 65 so that the rack 65*a* meshes with a pinion gear 55 that is provided on the lower tray 50. That is, the sliding member 65 (the upper tray 60) is configured to be slidably displaced as the pinion gear 55 rotates.

The pinion gear 55 is capable of meshing with a driving gear (not shown) provided on the main body of the printer 1, when the sheet cassette 100 is mounted in the main body of the printer 1. The driving gear is rotated by a motor, which is not shown in the figure, thereby driving the sliding member 65 (the upper tray 60).

A locking member 65*b* is formed at a position slightly ahead of the rack 65*a*. The locking member 65*b* is configured to be put under a restraining rail 50*d* that is formed on the lower tray 50. When the locking member 65*b* is put under the restraining rail 50*d* (the locking member 65*b* is on the A side with respect to the position L indicated in FIG. 3, which is hereinafter referred to as "active area" of the upper tray 60), the rack 65*a* meshes with the pinion gear 55 while the locking member 65*b* is put under the restraining rail 50*d*, thereby restraining the sliding member 65 (the upper tray 60) so as not to be removed from the lower tray 50.

On the other hand, when the locking member 65*b* is ahead of the restraining rail 50*d* without being engaged with the restraining rail 50*d* (the locking member 65*b* is on the B side with respect to the position L indicated in FIG. 3, which is hereinafter referred to as "inactive area" of the upper tray 60), the rack 65*a* is not meshed with the pinion gear 55 while the locking member 65*b* is disengaged from the restraining rail 50*d*, thereby allowing the sliding member 65 (the upper tray 60) to be removed from the lower tray 50 (as shown by the virtual line and reference numeral 60' in FIG. 2). The inactive area of the upper tray 60 according to this embodiment is a position at which the upper tray 60 has been slid to the front-most position.

As mentioned above, the sheet cassette 100 having a multi-tray configuration composed of the lower tray 50 and the upper tray 60 is configured such that the upper tray 60 is removable from the lower tray 50. Consequently, the sheet storing capacity of the lower tray 50 increases when the upper tray 60 is removed, thereby further improving usability of the lower tray 50. Moreover, the space for storing the sheets in the lower tray 50 is fully opened when the upper tray 60 is removed, thereby further improving operability in loading the sheets into the lower tray 50.

In this embodiment, the upper tray 60 is slidably displaceable by means of driving units such as the rack 65*a*, the pinion gear 55 and a motor that drives the pinion gear 55 (not shown). In addition to that, the upper tray 60 is in a state of being restrained by the lower tray 50 in the active area of the upper tray 60, and the upper tray 60 is released from being in the restrained state in the inactive area. As a result, the upper tray 60 can be slidably displaced in a reliable manner without causing disengagement of the rack 65*a* from the pinion gear 55 in the active area.

Moreover, although the upper tray 60, when in the stand-by position, is located above the space for storing the sheets in the lower tray 50 in this embodiment, the upper tray 60 may be configured in other embodiments to be slidably displaceable to a position outside of the space for storing the sheets in the lower tray 50 so that the space for storing the sheets in the lower tray 50 can be fully opened without turning or removing the upper tray 60.

Furthermore, the upper tray 60 may be configured in other embodiments to be detachably mounted in the main body of the printer 1 separately from the lower tray 50, so that the sheets can be fed from the upper tray 60 without using the lower tray 50, thereby further improving usability.

3. Details of Edge Guide

The edge guide 52 that is provided on the lower tray 50 will be further described in detail with reference to FIGS. 4A to 5B.

As described above, the space for storing the sheets in the lower tray 50 increases when the upper tray 60 is removed from the lower tray 50, which enables an increased number of the sheets to be stored in the lower tray 50. However, if a guiding height of the edge guide 52 that is provided on the lower tray 50 remains the same, the sheets stored in the lower tray 50 cannot be guided in an appropriate manner after the upper tray 60 is removed.

Accordingly, the edge guide 52 that is provided on the lower tray 50 according to this embodiment is configured such that the guiding height of the guide surface is adjustable. More specifically, as shown in FIGS. 4A and 4B, the edge guide 52 includes a base 52*a* that slides along the bottom of the lower tray 50, an upright portion 52*b* formed integrally with the base 52*a* so as to be mounted upright on the base 52*a*, a plate member 52*c* that is rotatable with respect to the upright portion 52*b* about a rotation shaft 52*e* and a biasing unit, which is not shown in the figure, that biases the plate member 52*c* in a direction indicated by the arrow C1.

Reference numeral 52*d* denotes the guide surface along which the sheet edge is guided. The guiding height of the guide surface 52*d* is configured to increase as the plate member 52*c* rotates in the direction indicated by the arrow C1, from a first state shown in FIG. 4A to a second state shown in FIG. 4B.

More specifically, when the upper tray 60 is usually mounted on the lower tray 50, the plate member 52*c* is engaged with the bottom of the upper tray 60, that is, the plate member 52*c* is pressed down, thereby retaining the first state as shown in FIG. 4A.

Then, when the upper tray 60 is removed from the lower tray 50 as shown by reference numeral 60' in FIG. 2, the plate member 52*c* is disengaged from the upper tray 60. As a result, the plate member 52*c* is rotated by a biasing force from the biasing unit and switched to the second state as shown in FIG. 4B, thereby changing (increasing) the guiding height of the guide surface 52*d* from h0 (FIG. 4A) to h1 (FIG. 4B) (h1>h0).

That is, the guiding height of the guide surface 52*d* is adjustable and the guiding height of the edge guide 52 increases as the sheet capacity of the lower tray 50 increases, thereby enabling an increased number of stacked sheets to be accommodated. As a result, a sheet can be fed in an appropriate manner without causing a feeding problem such as skew feeding.

Moreover, in this embodiment, the guide surface 52*d* is formed by the plate member 52*c* that is rotatable about the rotation shaft 52*e* such that the guiding height of the guide surface 52*d* can be adjusted by rotation of the plate member 52*c*. Accordingly, a switching mechanism for the guiding height of the guide surface 52*d* can be achieved in a simple configuration at low cost.

In addition to that, the rotation shaft 52*e* forms a rotation axis which intersects (in this embodiment, perpendicular to) the guide surface 52*d* such that, when the plate member 52*c* rotates about the rotation shaft 52*e*, the edge of the sheets is aligned with a single surface of the guide surface 52*d* in both the first state and the second state. Accordingly, a smooth, flat or seamless guide surface is provided during setting of the sheets without causing a problem, such as a sheet getting stuck, in both the first state and the second state.

Further, since the guiding height of the guide surface 52*d* decreases when the edge guide 52 is engaged with the upper tray 60 and the guiding height of the guide surface 52*d* increases when the edge guide 52 is disengaged from the upper tray 60 in this embodiment, the guiding height of the guide surface 52*d* increases without needing a specific operation. Accordingly, a sheet cassette with high usability can be achieved. In addition, the upper tray 60 according to this embodiment remains in engagement with the edge guide 52 (the plate member 52*c*) when the upper tray 60 is mounted on the lower tray 50, regardless of the position where the upper tray 60 is located in the slidable area.

Although in the above-mentioned embodiment it has been described that the guiding height of the guide surface 52*d* is configured to be changed between two states, that is, a lower state (FIG. 4A) and a higher state (FIG. 4B), the guiding height may be changed in a stepwise manner for example by defining several height positions, or alternatively, the guiding height may be continuously changed. In such cases, it is desirable to provide a holding unit so as to retain the predetermined guiding height.

Another embodiment will be described with reference to FIGS. 5A and 5B. The same configurations as those of FIGS. 4A and 4B are referenced by the same reference numerals, while the configurations corresponding to but different from those of FIGS. 4A and 4B are referenced by the same reference numerals with a prime mark.

In FIGS. 5A and 5B, the edge guide 52' includes a base 52*a*, an upright portion 52*b'* formed integrally with the base 52*a* so as to be mounted upright on the base 52*a*, a plate member 52*c'* that is rotatable with respect to the upright portion 52*b'* about rotation shaft bearings 52*f* and a biasing unit, which is not shown in the figure, that biases the plate member 52*c'* in a direction indicated by the arrow C2. The rotation shaft bearing 52*f* is a bearing that supports a shaft (not shown) formed on the upright portion 52*b'*.

Reference numerals 52*d*-1 and 52*d*-2 denote guide surfaces along which the sheet edge is guided. In a first state shown in FIG. 5A, the guide surface 52*d*-1 formed by the upright portion 52*b'* constitutes a guide surface of the edge guide 52'. The guiding height in this configuration is h0.

Then, as the plate member 52*c'* rotates in the direction indicated by the arrow C2, thereby deploying the guide surface 52*d*-2 that is formed by the plate member 52*c'* on the guide surface 52*d*-1, the overall guiding height changes (increases) to h1 (h1>h0) from a first state shown in FIG. 5A to a second state shown in FIG. 5B.

Accordingly, also in this embodiment, the guiding height of the edge guide 52' increases as the sheet storing capacity of the lower tray 50 increases, thereby enabling the increased number of stacked sheets to be accommodated. As a result, the sheet can be fed in an appropriate manner without causing a feeding problem such as skew feeding.

Similar to the edge guide 52, which has been described with reference to FIGS. 4A and 4B, the edge guide 52' of this embodiment may be configured to retain the first state, which is achieved by the plate member 52*c'* engaging with the bottom of the upper tray 60, that is, being pressed down by the upper tray 60 when the upper tray 60 is mounted on the lower tray 50. Accordingly, the first state is not limited to a state in which the plate member 52*c'* has been fully rotated downward and is in close contact with the upright portion 52*b'* as shown in FIG. 5A, but also may be a state in which the plate member 52*c'* has been rotated to a certain extent in a direction indicated by the arrow C2 from the state shown in FIG. 5A.

In addition, the plate member 52*c'* in the second state shown in FIG. 5B may be inclined to a certain extent toward the first state in order to facilitate downward rotation of the plate member 52*c'* when the plate member 52*c'* is pressed down by the upper tray 60 in the state shown in FIG. 5B.

Furthermore, although the first state and the second state have been described to be switched by means of the edge guides 52 and 52' engaging with/disengaging from the upper tray 60, a holding unit, for example, may be separately provided so that the first state and the second state are retained by the holding unit and such retained state is released by an operation of a user.

Although the edge guides 52 and 52' have been described as to guide the side edge of the sheets, it is needless to say that the above edge guide may apply to an edge guide for the trailing edge of the sheets (shown by reference numeral 51 in FIG. 1).

The entire disclosure of Japanese Patent Application No: 2011-002751, filed Jan. 11, 2011 is expressly incorporated by reference herein.

What is claimed is:

1. A recording apparatus comprising:

a multiple-tray comprising an upper tray and a lower tray, wherein the upper tray is removable from the lower tray;

an edge guide which is disposed on the lower tray and has a guide surface along which a sheet edge is guided, the guide surface being formed by a plate member; and a biasing member that biases the plate member in a rotation direction;

wherein, when the upper tray is removed from the lower tray, the plate member is rotated by the biasing member, causing the edge guide in the lower tray to extend to increase in height to accommodate more sheets.

2. The recording apparatus according to claim 1, wherein the plate member is rotatable about a rotation axis which intersects the guide surface, and the guide surface is configured to have a height that varies as the plate member rotates.

* * * * *